US005584379A

United States Patent [19]

Bischoping et al.

[11] Patent Number: 5,584,379

[45] Date of Patent: Dec. 17, 1996

[54] DISCONNECT SWITCH DOUBLE MOTION MECHANISM

[75] Inventors: Thomas Bischoping, Greensburg, Pa.; George Iliff, Yuma, Ariz.

[73] Assignee: ABB Power T&D Company, Inc., Raleigh, N.C.

[21] Appl. No.: 342,234

[22] Filed: Nov. 18, 1994

[51] Int. Cl.[6] ..... H01H 31/00

[52] U.S. Cl. ..... 200/48 P; 200/48 A; 200/49

[58] Field of Search ..... 200/240, 244, 200/48 R, 48 P, 48 A, 48 KB, 48 V, 48 SB, 48 CB, 49; 74/63

[56] References Cited

U.S. PATENT DOCUMENTS

| | | | |
|---|---|---|---|
| 3,047,685 | 7/1962 | Sciscione | 200/48 A |
| 3,388,225 | 6/1968 | Foti | 200/48 |
| 3,836,737 | 9/1974 | Redfern | 200/48 A |
| 4,001,530 | 1/1977 | Redfern | 200/48 |
| 4,379,956 | 4/1982 | Cleaveland et al. | 200/48 A |

OTHER PUBLICATIONS

TTT7 Double Break Group–Operated Outdoor Disconnect Switches, ABB Power T&D Company Inc., Supercedes Bulletin, 2.3.6–1A, Jun. 1991.

*Primary Examiner*—David J. Walczak
*Attorney, Agent, or Firm*—Woodcock, Washburn, Kurtz, Makiewicz & Norris

[57] ABSTRACT

A double-sided break switch is provided which is operated by a double motion mechanism that rotates the blade about its own axis.

7 Claims, 6 Drawing Sheets

DISCONNECT SWITCH DOUBLE MOTION MECHANISM

FIELD OF THE INVENTION

The present invention relates generally to disconnect switches and more particularly to a double motion mechanism for operating a disconnect switch.

BACKGROUND OF THE INVENTION

A disconnect switch is a mechanical device used for changing the connections in a circuit or for isolating a circuit or other equipment from a power source. One type of disconnect switch is the double motion, double-sided break switch, an example of which is depicted in FIG. 1. As explained in more detail below, it is conventional in disconnect switches to employ a movable switch blade that is first rotated from a pivot point so as to move into the region of a cooperating jaw contact. During a part of this rotational movement, the blade is rotated about its longitudinal axis so as to bring its beavertail contact(s) into rigid engagement with the cooperating contact surfaces of the jaw(s). This provides good engagement under pressure between the jaw contacts and the beavertail contact(s). See, for example, U.S. Pat. No. 3,388,225, Jun. 11, 1968, titled "Jaw For Ice Breaking Switch."

FIG. 1 depicts a recent example of a prior art disconnect switch 10. In this embodiment, three electrical insulator stacks 12*a*, 12*b*, and 14 are mounted on a common base. The two outside stacks 12*a*, 12*b* are rigidly mounted and have terminal pads for connection to a circuit. The center stack 14 is mounted on a bearing 16 so that it can rotate about its longitudinal axis by operation of a crank 16*a* or the like. The two outside stacks 12*a*, 12*b* support first and second resilient contact jaw members 18*a*, 18*b*. As the center stack 14 rotates, a housing 20 through which a conducting tube or blade 22 passes makes or breaks the circuit as shown in FIGS. 2A and 2B. FIG. 2A depicts the conducting blade 22 in an open position, and FIG. 2B depicts the blade in a closed position.

As the disconnect switch approaches a fully closed position, the blade 22 first enters the stationary contacts 18*a*, 18*b* as shown in FIG. 3 and then rotates into a fully closed position as shown in FIG. 4. That is, the blade 22 rotates about the longitudinal axis of the center insulator 14 until the contact portions 24*a*, 24*b* enter the contact jaws 18*a*, 18*b* respectively, at an inclined angle. At this point, the blade 22 rotates about its longitudinal axis so that the contact portions 24*a*, 24*b* rotate to a vertical position as shown in FIG. 4. This latter rotation provides the wiping motion needed to insure good contact and to allow the switch 10 to perform under icing conditions. This arrangement reduces the operating forces needed to close the switch 10. Traditionally, in the prior art, this rotation of the blade 22 has been accomplished as shown schematically in FIG. 5. In the arrangement depicted in FIG. 5, the center stack 14 (FIG. 1) is rotated so that the blade 22 assumes the "partially closed" position, i.e., a position in which the blades ends are in contact with the jaws but at an inclined angle. At this point, the blade hits the stationary contacts 18*a*, 18*b* and will not travel any further. However, the center insulator stack 14 continues to rotate, which forces rotation of the blade about the blade's axis 34 by means of a gear arrangement. This is schematically depicted in FIG. 5 as a linkage 30 attached at a connection point 32 to a collar crank that engages the blade 22 and rotates it about the blade's longitudinal axis 34. A force vector 36 is also depicted in FIG. 5. Thus, in this prior art arrangement, the blade rotates about its own axis by means of a force or movement at the end of a crank, lever, or gear.

Of course, there are other features of the prior art that are known to those skilled in the art. For example, both the blade and jaw contacts utilize high-pressure, silver-to-copper construction. Furthermore, throughout the current carrying parts, all bolts, nuts and pins are stainless steel, minimizing the possibility of corrosion. A galvanized structural steel channel base is used to support the insulators and live parts, providing strength and rigidity. The contact blades are preferably heavy, one piece tubular aluminum with replaceable copper contacts at each end. Silver-surfaced edges of the contact ends engage with tinned copper jaw fingers to provide a silver-to-tinned copper contact. The rotating motion of the blade provides a self-cleaning wiping of the contacts. Contact pressure is applied to the copper jaw fingers by stainless steel springs, which are insulated at one end. Jaw contact pressure is increased as current increases due to a reverse loop finger design. Magnetic forces due to fault currents tend to push the blade deeper into the jaw. The number of contact fingers provided is varied depending on the current carrying capability of the switch.

SUMMARY OF THE INVENTION

A disconnect switch in accordance with the present invention includes first and second resilient contact members (18*a*, 18*b*), a contact blade 22 mounted on a support member (14) having at opposite ends thereof contacts (24*a*, 24*b*) that bear against the first and second resilient contact members (e.g., contact jaws) when the support member on which the contact blade is mounted is rotated. When the first and second contacts are in a partially closed position with respect to the first and second resilient contact members, a closing means rotates the contact blade about its central axis upon further rotation of the support member carrying the contact blade. In this manner, the ends of the blade rotate to a fully closed position with respect to the first and second resilient contact members.

In the preferred embodiment of the invention described in detail below, the closing means comprises a housing (20) through which the contact blade extends; a pair of diametrically opposed slotted holes (40*a*, 40*b*) in the housing, the contact blade passing through the slotted holes; a first collar crank (60*a*) coupled to the blade and attached to the housing at a first pivot point (41*a*); and a second collar crank (60*b*) coupled to the blade and attached to the housing at a second point (41*b*). Collar cranks (60*a*, 60*b*) have slotted openings (90) enabling the cranks (60*a*, 60*b*) and the contact blade 22 to move along the pivot points and thereby enable the contact blade 22 to rotate about its central axis.

Other features of the invention are disclosed below.

DETAILED DESCRIPTION OF PREFERRED EMBODIMENTS

Figure 6:
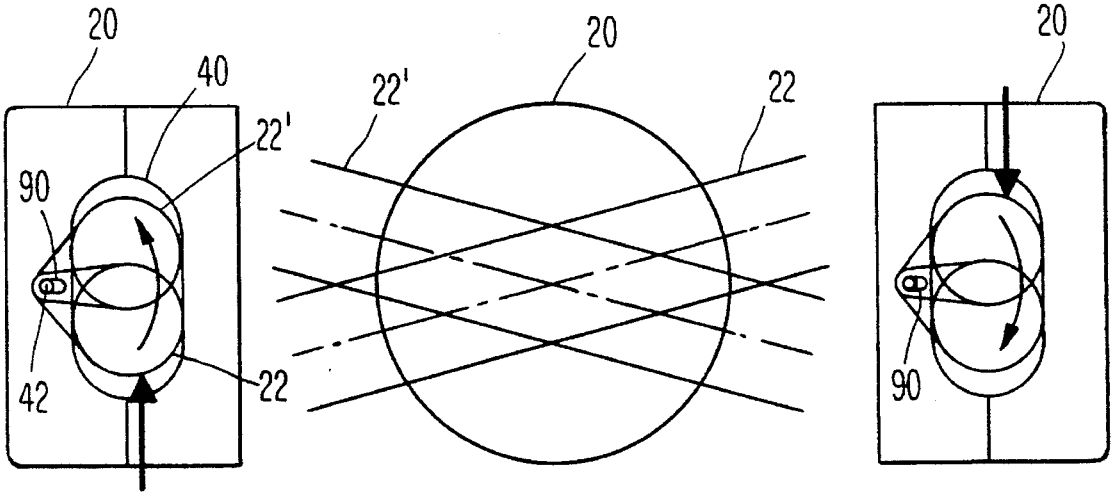
FIG. 6 schematically depicts how the contact blade is rotated about a remote axis in accordance with the present invention.

FIG. 6 is a schematic depiction of one aspect of the present invention. The center portion of FIG. 6 is a top view of the housing 20 with the blade in an open position 22 and closed position 22'. The left hand portion of FIG. 6 is a side view of the housing 20. This view shows the slotted hole 40 in the housing and the pivot point 42, which in the prior art was the connection between the linkage 30 and the collar crank. In the present invention, the pivot point 42 is the point about which a force is applied to the collar cranks (60*a*, 60*b*) which rotates the blade 22 about its central axis when a force is applied directly to the blade as indicated by the arrow. Slotted openings 90 in each of the collar cranks (60*a*, 60*b*) at the attachment point of the pins (42*a*, 42*b*) enable the cranks (60*a*, 60*b*) and the blade 22 to move along the pivot points and thereby enable the blade 22 to rotate about its central or longitudinal axis. In one preferred embodiment of the invention, the angular extent of the slotted hole 40 is approximately 35°. The right hand portion of FIG. 6 is a view of the opposite side of the housing 20. In this figure, the bottom of the housing 20 is the edge with the rounded corners.

Figure 7:
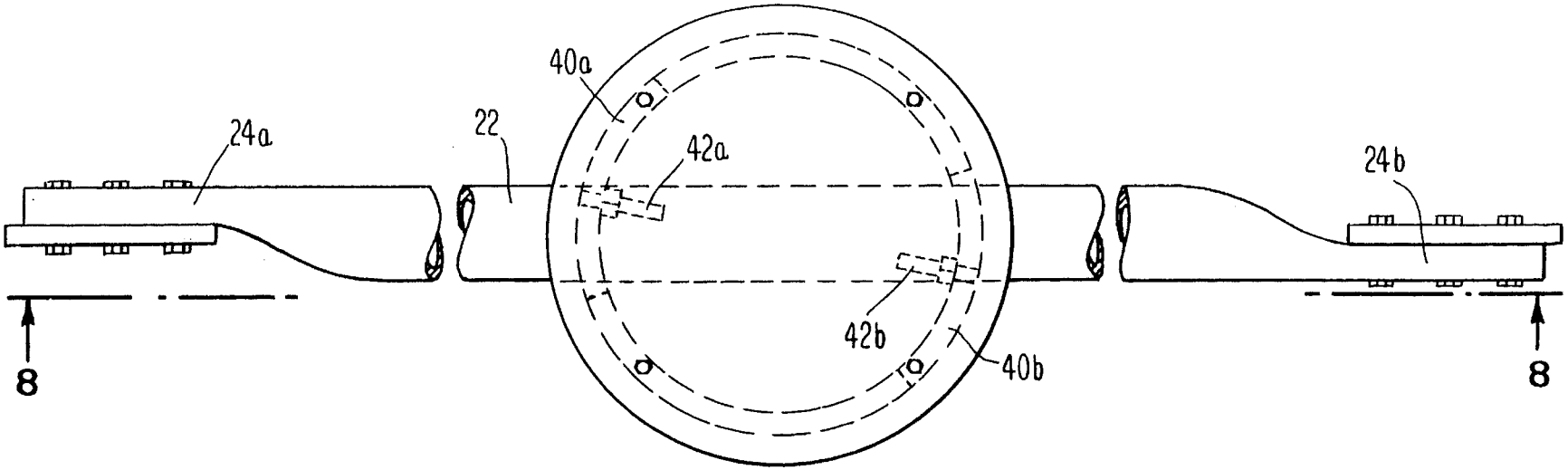
FIG. 7 is a top view of one preferred embodiment of the present invention in the closed position.

Referring now to FIG. 7, which depicts a top view of the housing 20, the blade 22 passes through the housing and is attached to the housing via a collar crank (not shown in this view) and a pin or bolt at pivot points 42*a* and 42*b*. The blade 22 is in the close position in FIG. 7. Stationary contacts 18*a* and 18*b* are not shown in FIG. 7 (or FIG. 8) for purposes of clarity.

Figure 8:
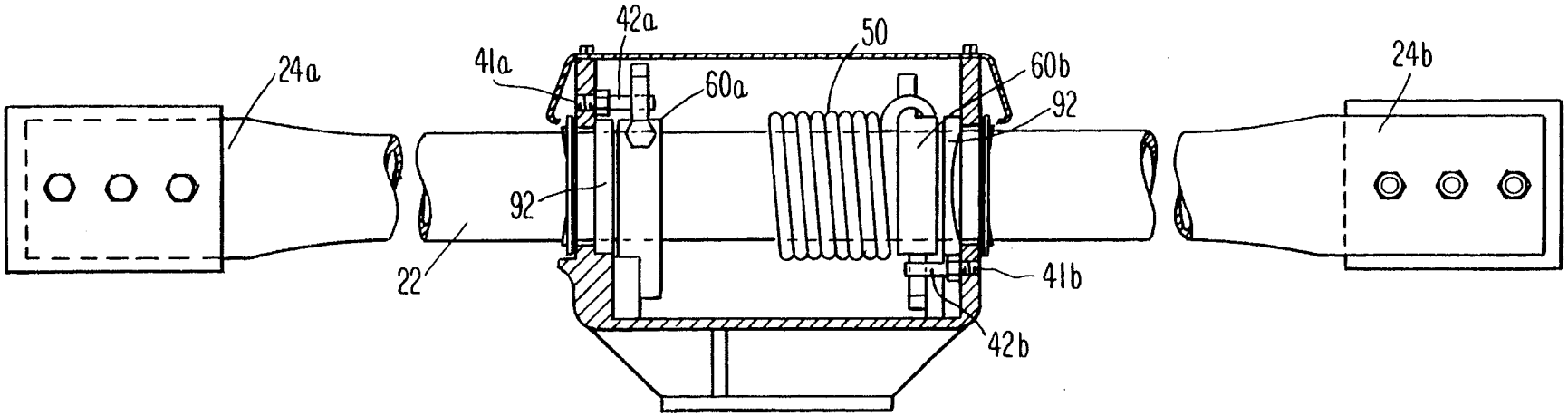
FIG. 8 is a cross-sectional side view of the embodiment of FIG. 7 in the closed position.
Figure 9:
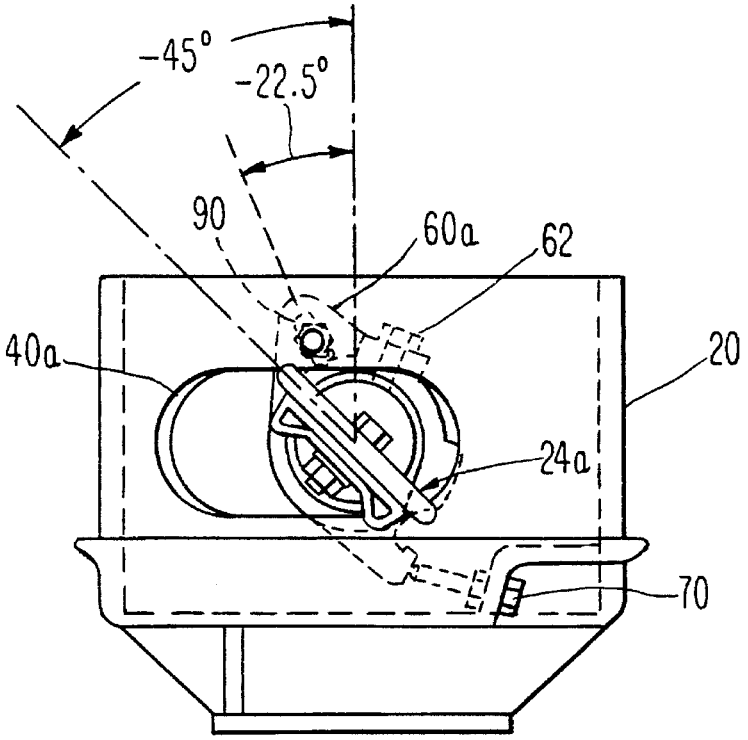
FIG. 9 is an end view of the embodiments of FIGS. 7 and 8. This view shows the position of the collar crank and beavertail contact in an open position.

Referring to FIGS. 8 and 9, which depicts the in a fully closed position with respect to the resilient contact jaws 18*a*, 18*b*(not shown in FIG. 8), the means for rotating the blade about its longitudinal axis includes the slotted collar cranks 60*a* and 60*b*, and the pins 42*a* and 42*b* attaching the collar cranks 60*a*, 60*b* to the housing 20 as shown. The blade 22 passes through low friction plastic guide members 92 which support blade 22 and permit low friction relative movement between the blade 22 and housing 20. The pivot points 41*a* and 41*b* about which the slotted openings 90 of collar cranks move are aligned with the pins 42*a* and 42*b* thus permitting the cranks (60*a*, 60*b*) and the contact blade 22 to move along the pivot points and thereby enable the contact blade 22 to rotate about its central axis. That is, the blade rotates about the pins. FIG. 8 also shows a spring 50, which holds the collar crank 60*b* and blade 22 in an open position until they are forced to a closed position by rotation of the housing 20 as described below.

FIG. 9 depicts the housing 20, collar crank 60*a* with slotted opening 90, low friction plastic guide 92, and beavertail contact 24*a* in an open position. As shown, the blade 22 is positioned near the right hand end of the slotted hole 40*a*. In fact, the blade would touch the right hand edge of the slotted hole if it were not for the stop bolt 70 bearing against the collar crank 60*a*. As shown, the collar crank 60*a* is rotated to an angle of −22.5 ° with respect to a vertical axis of the housing 20. The beavertail contact 24*a* is rotated −45° with respect to the same vertical axis. During the 45 ° rotation of the blade 22, the relationship between the blade central axis and pin 42*a* remains constant. The slot opening 90 at the collar crank (60*a*) connection to pin 42*a* permits relative movement so that the blade 22 can rotate about its own central or longitudinal axis. Of course, the opposite beavertail contact 24*b* (not shown in FIG. 9) and the other collar crank 60*b* are similarly rotated.

Figure 1:
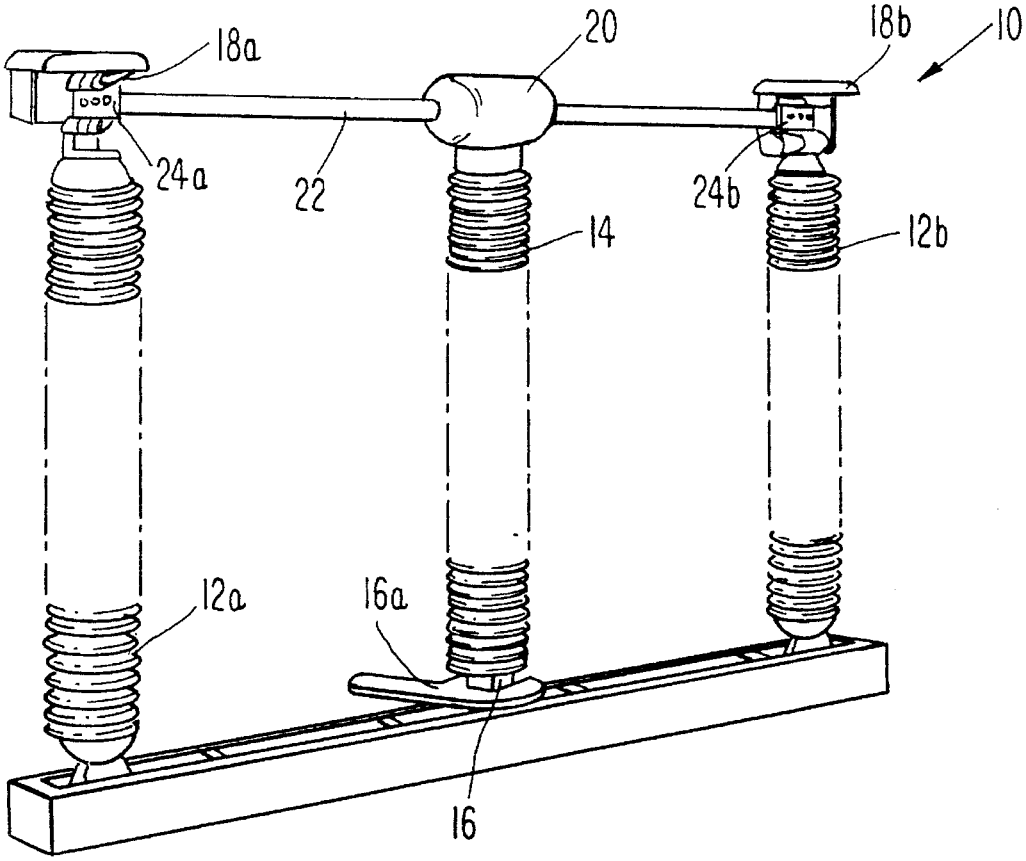
PRIOR ART Fig. 1
FIG. 1 depicts a prior art double-sided disconnect switch.
Figure 3:
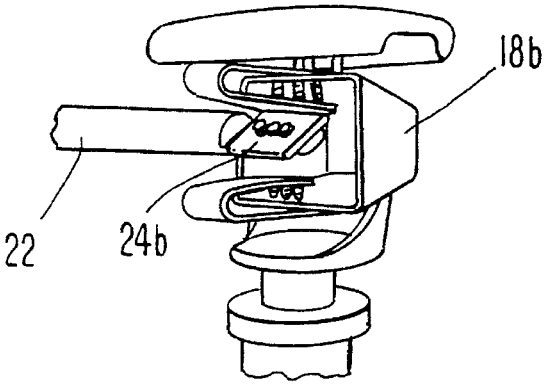
PRIOR ART Fig. 3
FIG. 3 depicts prior art and shows the blade in a partially closed position, i.e., at an oblique angle with respect to the contact jaw.
Figure 4:
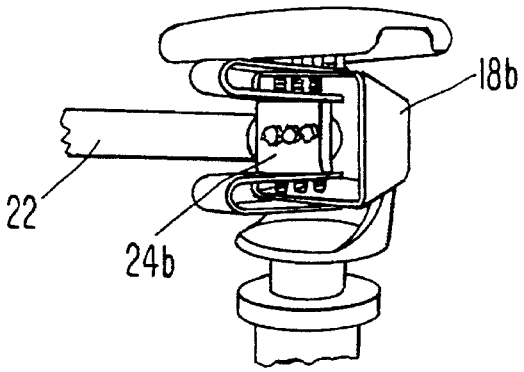
PRIOR ART Fig. 4
FIG. 4 depicts prior art and shows the contact blade in a fully closed position, i.e., rotated so that the contact at the end of the blade is at a right angle with respect to the contact jaws.
Figure 2A:
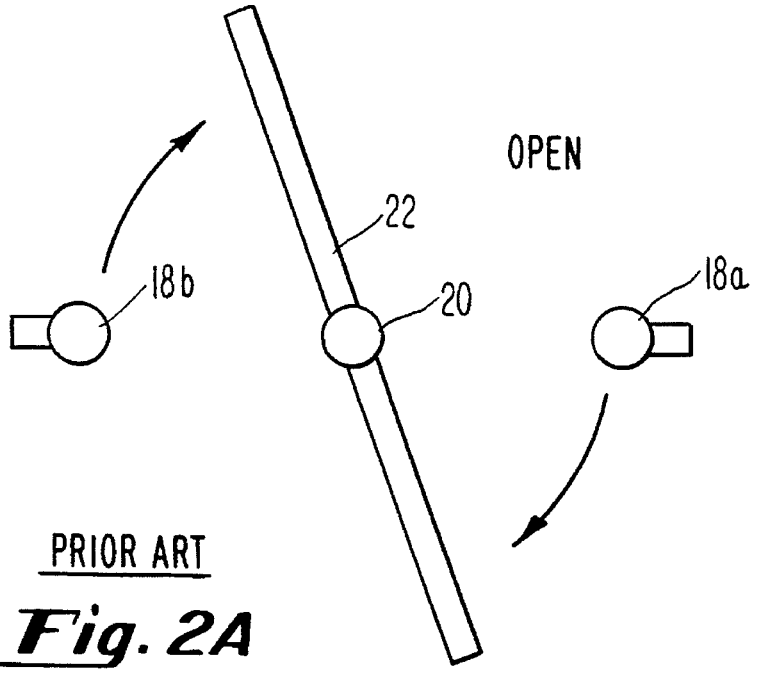
PRIOR ART Fig. 2A
FIG. 2A schematically depicts a prior art double-sided disconnect switch in an open position and FIG. 2B schematically depicts the prior art double-sided disconnect switch in a closed position.
Figure 2B:
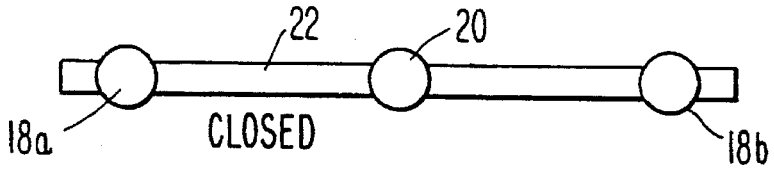
PRIOR ART Fig. 2B
FIG. 2C is depicts prior art and a top view showing the angles over which the blade and housing are rotated.
Figure 2C:
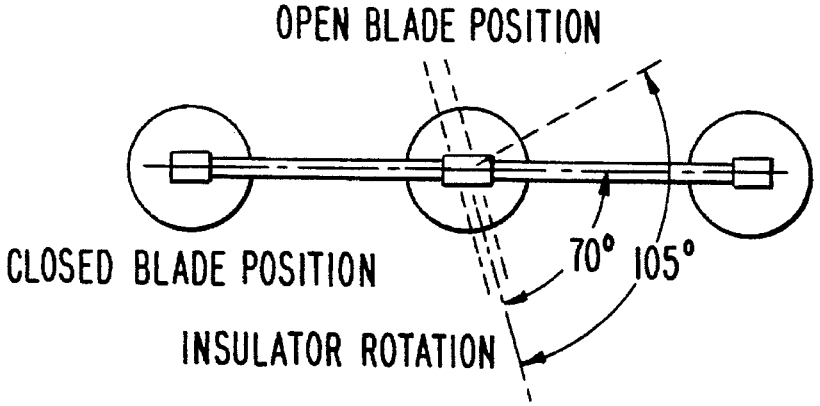
Fig. 2C PRIOR ART
Figure 5:
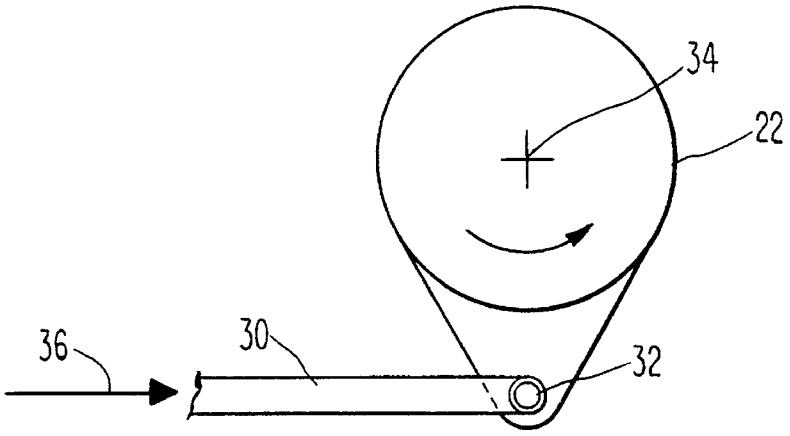
PRIOR ART Fig. 5
FIG. 5 schematically depicts how, in the prior art, the blade is rotated about its own longitudinal axis.
Figure 10:
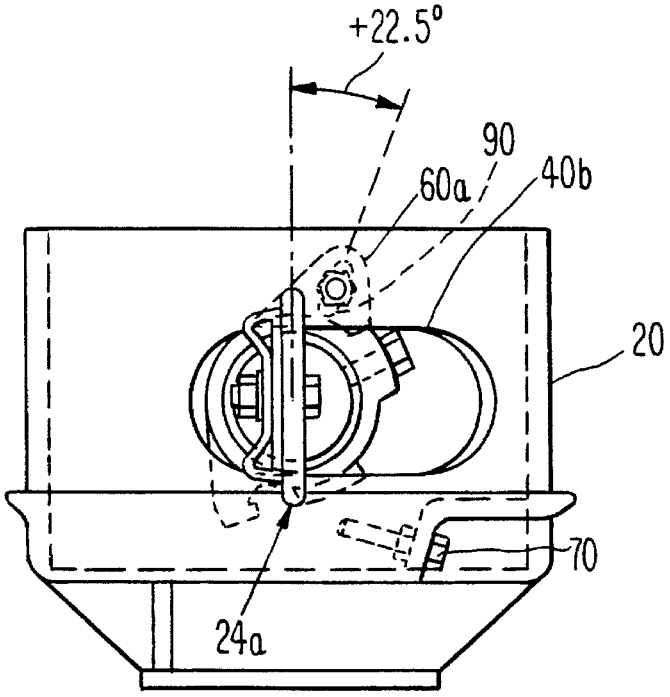
FIG. 10 is similar to FIG. 9 but with the collar crank and beavertail contact in a closed position.

FIG. 10 shows the housing, collar crank, and beavertail contact in the closed position. As shown, the beavertail contact is rotated to an angle of 0° with respect to the vertical axis, and the collar crank is rotated to an angle of +22.5°. Thus, both the beavertail contact and the collar crank have undergone a rotation of 45°. In this position, the blade is adjacent to the left hand edge of the slotted hole 40*b*. Thus, rotation of the housing 20 from the position of FIG. 9 to the position of FIG. 10, which in this preferred embodiment is approximately 35°, causes the blade 22 to be rotated 45°. Thus, the contacts 24*a* and 24*b* at the end of the blade 22 hit or abut or bear against the stationary contact jaws 18*a* and 18*b* in a fashion similar to that as depicted in FIG. 3 and will not travel any further. The contact jaws 18*a* and 18*b* therefore enter the area of contact jaws 18*a* and 18*b* at an oblique angle (i.e., 45°) and subsequently are rotated to a vertical position. This provides the wiping action necessary to clean the contact jaws, particularly of ice, and insures a good electrical contact between the respective contacts 24*a* and 24*b* and the jaws 18*a* and 18*b*.

Figure 11:
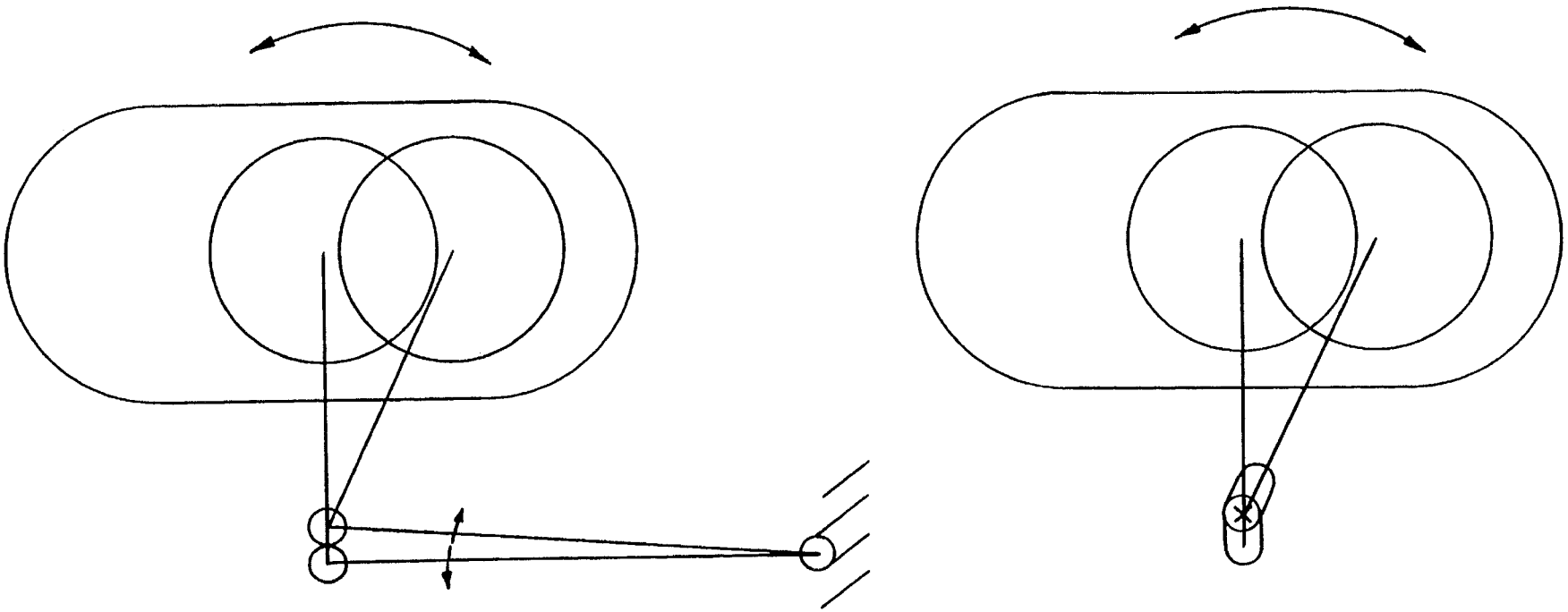
FIG. 11 depicts an embodiment of the invention in which the pins 42*a*, 42*b* have been replaced with a lever system.

The present invention is not limited to the preferred embodiment disclosed herein. For example, the 22.5°, 35° and 45° angles discussed in connection with the preferred embodiment can, of course, be varied. In addition, the invention disclosed herein can be employed to operate a double motion grounding switch. Finally, pins 42*a*and 42*b* and the slotted hole in the collar crank could be replaced by a lever system, as depicted in FIG. 11.

We claim:

1. A disconnect switch comprising:

(a) first and second resilient contact members (18*a*, 18*b*) mounted respectively on first and second support members (12*a*, 12*b*);

(b) a contact blade mounted on a third support member (14), wherein opposite ends of said contact blade (24*a*, 24*b*) bear against said first and second contact members when said third support member is rotated about a longitudinal axis thereof until said ends are in a partially closed position; and (c) closing means (20, 40, 42*a*, 42*b*, 60, 62) for rotating said contact blade about a longitudinal axis thereof upon further rotation of said third support member, whereby said ends of said blade rotate to a fully closed position with respect to said first and second resilient contact members said closing means comprising a housing (20) through which said contact blade extends; a pair of diametrically opposed slotted holes (40*a*, 40*b*) in said housing, said contact blade passing through said slotted holes; a first collar crank (60*a*) coupled to said blade and attached to said housing at a first pivot point (41*a*); and a second collar crank (60*b*) coupled to said blade and attached to said housing at a second pivot point (41*b*), each of said collar cranks having a slotted opening (90) therein enabling each of said cranks and said contact blade to move along said pivot points and thereby enable said contact blade to rotate about its longitudinal axis.

2. A disconnect switch as recited in claim 1, further comprising means (50) for holding said contact blade in a first rotational position with respect to its longitudinal axis until said closing means is actuated upon by said further rotation of said third support member to thereby rotate said ends of said blade to said fully closed position.

3. A disconnect switch as recited in claim 2, further comprising a stop member (70) for limiting the rotation of said blade about its longitudinal axis when said blade is in an open position.

4. A disconnect switch as recited in claim 1, further comprising a stop member (70) for limiting the rotation of said blade about its longitudinal axis when said blade is in an open position.

5. A switch comprising:

(a) a first contact member;

(b) a contact blade mounted on a support member, wherein an end of said contact blade bears against said first contact member when said support member is rotated about a longitudinal axis thereof until said end is in a partially closed position; and (c) closing means for rotating said contact blade about a longitudinal axis thereof upon further rotation of said support member, whereby said end of said blade rotates to a fully closed position with respect to said first contact member, said closing means comprising a housing into which said contact blade extends; a slotted hole in said housing, said contact blade passing through said slotted hole; and a collar crank coupled to said blade and attached to said housing at a pivot point, said collar crank having a slotted opening therein enabling said collar crank and said contact blade to move along said pivot point and thereby enable said contact blade to rotate about its longitudinal axis.

6. A switch as recited in claim 5, further comprising means for holding said contact blade in a first rotational position with respect to its longitudinal axis until said closing means is actuated upon by said further rotation of said support member to thereby rotate said end of said blade to said fully closed position.

7. A disconnect switch as recited in claim 6, further comprising a stop member for limiting the rotation of said blade about its longitudinal axis when said blade is in an open position.

* * * * *

UNITED STATES PATENT AND TRADEMARK OFFICE

CERTIFICATE OF CORRECTION

PATENT NO. : 5,584,379

DATED : December 17, 1996

INVENTOR(S) : Thomas Bischoping and George Iliff

It is certified that error appears in the above-indentified patent and that said Letters Patent is hereby corrected as shown below:

At col. 3, line 55, after the words "which depicts the" insert the words --blade 22--

Signed and Sealed this

Twenty-fifth Day of March, 1997

*Attest:*

Bruce Lehman

BRUCE LEHMAN

*Attesting Officer*

*Commissioner of Patents and Trademarks*